US009990831B2

(12) United States Patent
Keyton

(10) Patent No.: US 9,990,831 B2
(45) Date of Patent: Jun. 5, 2018

(54) HOME INCARCERATION CONFIRMATION SYSTEM

(71) Applicant: Kris Keyton, Fort Smith, AR (US)

(72) Inventor: Kris Keyton, Fort Smith, AR (US)

( * ) Notice: Subject to any disclaimer, the term of this patent is extended or adjusted under 35 U.S.C. 154(b) by 0 days. days.

(21) Appl. No.: 14/634,768

(22) Filed: Feb. 28, 2015

(65) Prior Publication Data

US 2016/0253889 A1 Sep. 1, 2016

(51) Int. Cl.
*G08B 23/00* (2006.01)
*G08B 21/22* (2006.01)

(52) U.S. Cl.
CPC ..... *G08B 21/22* (2013.01)

(58) Field of Classification Search
CPC ..... G08B 21/0261
USPC ..... 340/573.4, 539.13
See application file for complete search history.

(56) References Cited

U.S. PATENT DOCUMENTS 5,448,221 A * 9/1995 Weller ..... G08B 21/22 340/539.21
6,639,516 B1 * 10/2003 Copley ..... G08B 21/0283 340/426.17
6,762,684 B1 * 7/2004 Camhi ..... G08B 21/0211 340/573.1
7,119,690 B2 * 10/2006 Lerch ..... G06K 19/07381 340/568.2
7,123,141 B2 * 10/2006 Contestabile ..... G08B 21/0269 340/539.1
7,542,906 B2 * 6/2009 Duke ..... G06Q 99/00 704/270
7,590,232 B2 * 9/2009 Carter ..... G07C 9/00158 379/209.01
8,797,210 B2 * 8/2014 Derrick ..... G07C 1/20 342/357.54
2005/0057359 A1 * 3/2005 Coffey ..... G08B 21/0202 340/539.21
2005/0116811 A1 * 6/2005 Eros ..... G07C 9/00087 340/5.82
2005/0285747 A1 * 12/2005 Kozlay ..... G08B 21/22 340/573.4
2008/0088437 A1 * 4/2008 Aninye ..... G07C 9/00111 340/539.13
2012/0050532 A1 * 3/2012 Rhyins ..... G01S 5/14 348/143
2014/0285340 A1 * 9/2014 Campas, Sr. ..... G08B 13/1427 340/539.32

* cited by examiner

*Primary Examiner* — Eric M Blount
(74) *Attorney, Agent, or Firm* — Braxton Perrone, PLLC

(57) ABSTRACT

A location confirmation platform of a home confinement location confirmation system for establishing a virtual boundary in which an incarcerated individual is authorized to occupy and polling and confirming the individual's presence within the boundary by comparing previously collected individual attribute data and comparing the collected data to corresponding data received from the individual in real time.

19 Claims, 4 Drawing Sheets

HOME INCARCERATION CONFIRMATION SYSTEM

TECHNICAL FIELD

This disclosure relates generally to a system and methods for confirming the location of an incarcerated individual's location through use of a wireless device and a previously designated boundary established through a geo-fencing capability. An individual receives a requests to confirm a location and the individual's response to the request indicates whether the individual is present within the previously designated boundary.

DESCRIPTION OF RELATED ART

The criminal justice system and local, state and federal departments of corrections need to regularly confirm the whereabouts of incarcerated individuals confined to both detention facilities and outside of detention facilities, such as those confined to house arrest. Many departments of corrections employ technology incorporating global positioning technology (GPS) to monitor the location of the individual wearing the device in which the GPS capability resides. Most commonly, those under house arrest wear a GPS enabled bracelet that is affixed to the ankle. This allows corrections personnel to track the incarcerated individual's location. The problem with traditional location tracking devices is that they can be bypassed or fooled and the large volume of those under house arrest makes the task of tracking each in an efficient way problematic. There is, therefore, a need for efficiently and accurately tracking and confirming the location of an individual under home incarceration.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DESCRIPTION OF THE EMBODIMENTS

Several embodiments of Applicant's invention will now be described with reference to the drawings. Unless otherwise noted, like elements will be identified by identical numbers throughout all figures. The invention illustratively disclosed herein suitably may be practiced in the absence of any element which is not specifically disclosed herein.

In one embodiment of the presently disclosed house arrest confirmation system, information concerning an incarcerated individual are stored in one or more databases associated with a department of corrections server. A department of corrections server may be accessed by municipal authorities including members of the court system, law enforcement personnel, probation officers and the like. In addition, third parties such as bail bondsmen may access or maintain such a server to ascertain the location of an individual. The incarcerated individual information stored in the database(s) includes the individual's name, age, gender, offense, period of incarceration, address of home confinement location, photographs and other biometric identification data, such as digital images of the individual's fingerprints, facial photographs, voice characteristics and the like. In a scheduling database associated with the department of corrections server, information such as the global positioning coordinates of the location of home confinement and the schedule by which the individual's location is to be confirmed is also stored. In some instances, the individual may be confined to only home confinement, meaning the individual may leave the home under no circumstances, unless express permission by corrections personnel is received. For other individuals, confinement within the home may be limited to certain times of day, while during other times of day the individual may travel to work, deliver children to school, care for family members, receive regularly scheduled medical treatment or counseling, or the like. In these situations where the individual is expected to arrive and stay at various locations at pre-established times of day or pre-established days, the scheduling database includes schedule and location data that reflects where the individual is expected to be at what time of day. In particular, the scheduling database will reflect that a particular individual should be located in the home during a established time duration and, by example, at a place of employment on certain days between certain hours. In this manner, the confirmation process that will be described below can function within these pre-defined scheduling parameters.

The individual data may be stored in a detainee database maintained by correction authorities and may include biometric identification data of an individual. This includes fingerprint data and a digital representation of an image of the individual's face. This information is used in the individual location confirmation process described below.

Figure 1:
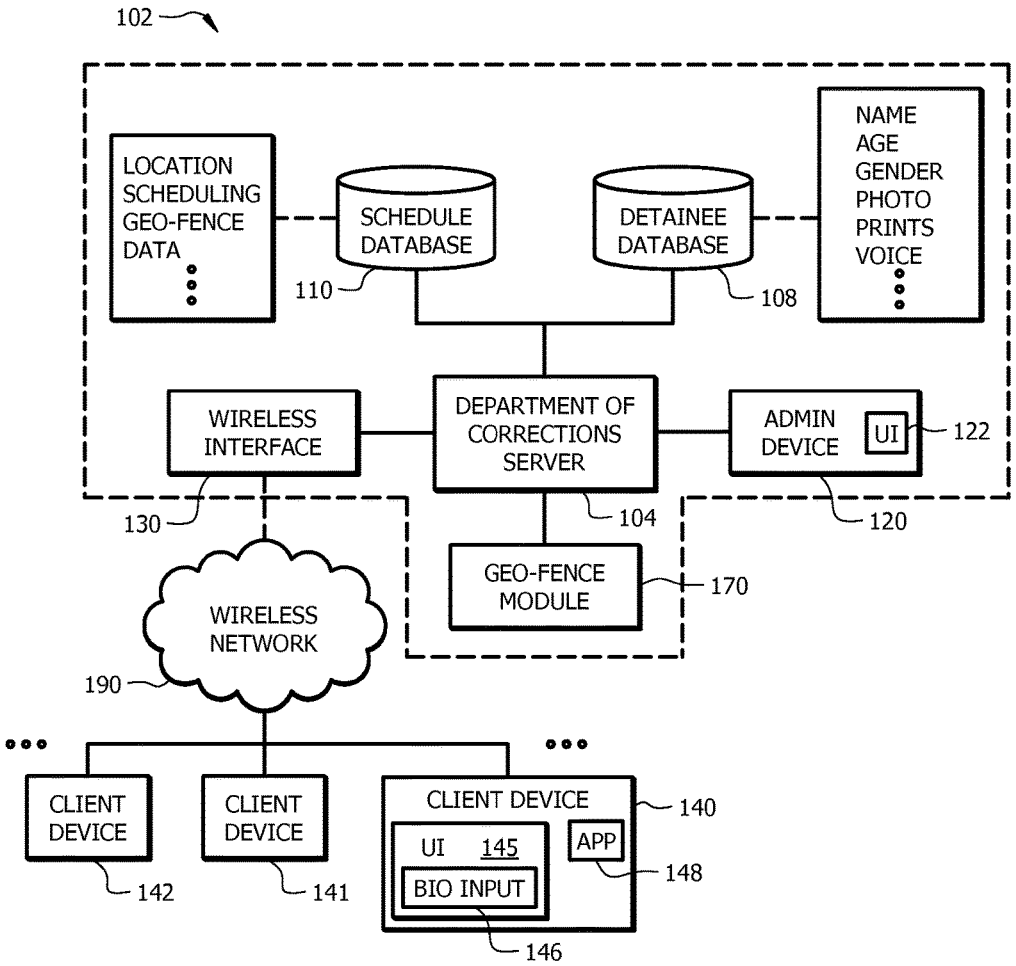
FIG. 1 is a block diagram of an embodiment of the present home incarceration confirmation system.

The system embodying the structure and functional elements of the presently described invention is depicted in FIG. 1. In FIG. 1, location confirmation platform 102 includes a department of corrections server 104 including a processor 106 and associated databases including detainee database 108, which includes individual detainee data and scheduling database 110 including scheduling data for the particular detainee. Detainee database 108 includes data fields associated with an individual detainee, as described above. Scheduling database 110 includes an address or addresses at which a detainee is expected various times during the day. Among the data stored in scheduling database is data representing the address at which the detainee resides or is to be held during the house arrest period. The data base may also include precise latitude and longitude coordinate data representing this address. Other addresses of locations where the detainee is permitted to be during various times of the day, week or month are also included in scheduling database. Location confirmation platform 102 may reside remotely from client device 140 or may be a local control unit that resides locally to client device 140. Location confirmation platform may communicate with client device 140 via known wired or wireless protocols such as WiFi, Bluetooth or other protocols.

An administrator device 120, which may be a desktop computer, portable device, smart phone, tablet or the like, includes a user interface 122. Through this interface, a corrections department administrator or authorized vendor may set or modify parameters associated with the house arrest confirmation system 100. By example, if a detainee is required to visit a counselor from 3 p.m. to 4 p.m. local time each Thursday, the schedule database 110 may be updated accordingly with a regularly set time and date of the counseling session as well as the address of the counseling session. The detainee database may also be updated to include the counselor's name as well as a document reflecting authorization for such sessions. Similarly, through administrator device 120, an administrator can monitor confirmation reports on all or a select group of detainees according to set filtering criteria.

Department of corrections server 104 communicates with a wireless network interface 130 to communicate over wireless network 190. Over wireless network 190, the location confirmation platform 102 may communicate with a variety of client devices 140, 141 and 142 associated with each detainee. Each client device 140, 141, and 142 includes a user interface 145 as well as a biometric data input device 146. In one embodiment, the client device is a smart phone, such as an Apple iPhone. The biometric data input device 146 of a device such as the iPhone may be the camera capability of the iPhone. In this manner, a photograph of the face of the detainee is the biometric data that is recorded and transmitted to the location confirmation platform 102. In addition or in the alternative, the client device 140 may include a fingerprint sensor such as that provided in the iPhone via its Touch ID capability. Other smartphones include a camera and fingerprint sensor capability through which transactions may be executed with the phone. Software residing in mobile devices in conjunction with voice recording capability, such as an internal microphone or an external or detachable microphone, enable recording of an individual's voice and creation of a digital representation of the voice that may be stored in the detainee database for later use in connection with the location confirmation platform. An application program 148 is installed, either temporarily or permanently on client device 140. Application program 148 facilitates communication with location confirmation platform 102 and an internal wireless interface of client device 140 allows communication with other systems and devices, including location confirmation platform 102 according to various wireless or cellular network protocols.

In one embodiment client device 140 is a combination of a monitoring band and smart phone. The monitoring band is worn by the incarcerated individual around the wrist, ankle or other body part. The band operates in conjunction with a mobile device such as a smart phone equipped with an application for monitoring the location of the monitoring band in terms of its proximity to the smart phone. This is achieved in one embodiment through a control unit to which the monitoring band communicates via a wireless, short range protocol such as Bluetooth. The monitoring band includes wire of fiber optic circuitry and a closure device such as a clasp similar to that found on a watch. Once the clasp is connected to affix the monitoring band on to the incarcerated individual, the circuit of the monitoring band is completed and the associated control unit monitoring of the location of the monitoring band is invoked. The monitoring band clasp is of a non-removable design, meaning it is damaged upon removal. Of course, upon the breaking of the clasp to remove the device, the circuit is open and the control unit will detect this breach accordingly. In operation, the control unit is in communication with the monitoring band via a Bluetooth low energy transmitted and the control unit monitors the integrity of the band. In turn, the control unit communicates with the smart phone and the smart phone performs the operations of the client device 140 as described below through execution of an application installed on the smart phone. In operation, the monitoring band and smart phone will work in unison, with either the monitoring band or smart phone vibrating when a check-in or confirmation request is received from the location confirmation platform 102.

In other embodiments, the functionality of client device 140 may be incorporated into a wearable device.

In association with server 104 is geo-fencing module 170. Various geo-fencing invocation techniques are known. In one embodiment the geo-fence acts as an electronic jail cell. In one embodiment, geo-fencing module 170 establishes individual geo-fence boundaries according to the particular locations associated with a detainee according to data stored in schedule database 110. By example, based on a detainee's home address, a geo-fence setting a boundary around a dwelling at that location may be established. More particularly, local tax records could be used to specifically plot a boundary or for multi-unit dwellings plot a boundary of the individual's particular dwelling unit and surrounding areas such as common areas, back yards and the like. The geo-fencing module 170 creates the boundary or an approximation of the actual property boundary based on known real estate information. The boundary so created is stored in the scheduling database 110 and is associated with the individual detainee.

In the alternative, installed on the detainee's client device 140 is an application program 148 having instructions executed by the processor of device 140. Through this program, a geo-fence boundary is established in proximity to the place of confinement of the detainee. Depending on the size of the dwelling, a boundary of an approximate radius about a center point of the dwelling may be established. In this embodiment, the client's device 140 communicates with the geo-fencing module 170 to locate the device via GPS to designate the geo-fence. This boundary thus created is stored in the scheduling database 110 and is associated with the individual detainee. As additional locations and associated geo-fence boundaries are created for a particular individual based on authorized locations that a detainee may visit, boundaries for these locations are created.

Figure 2:
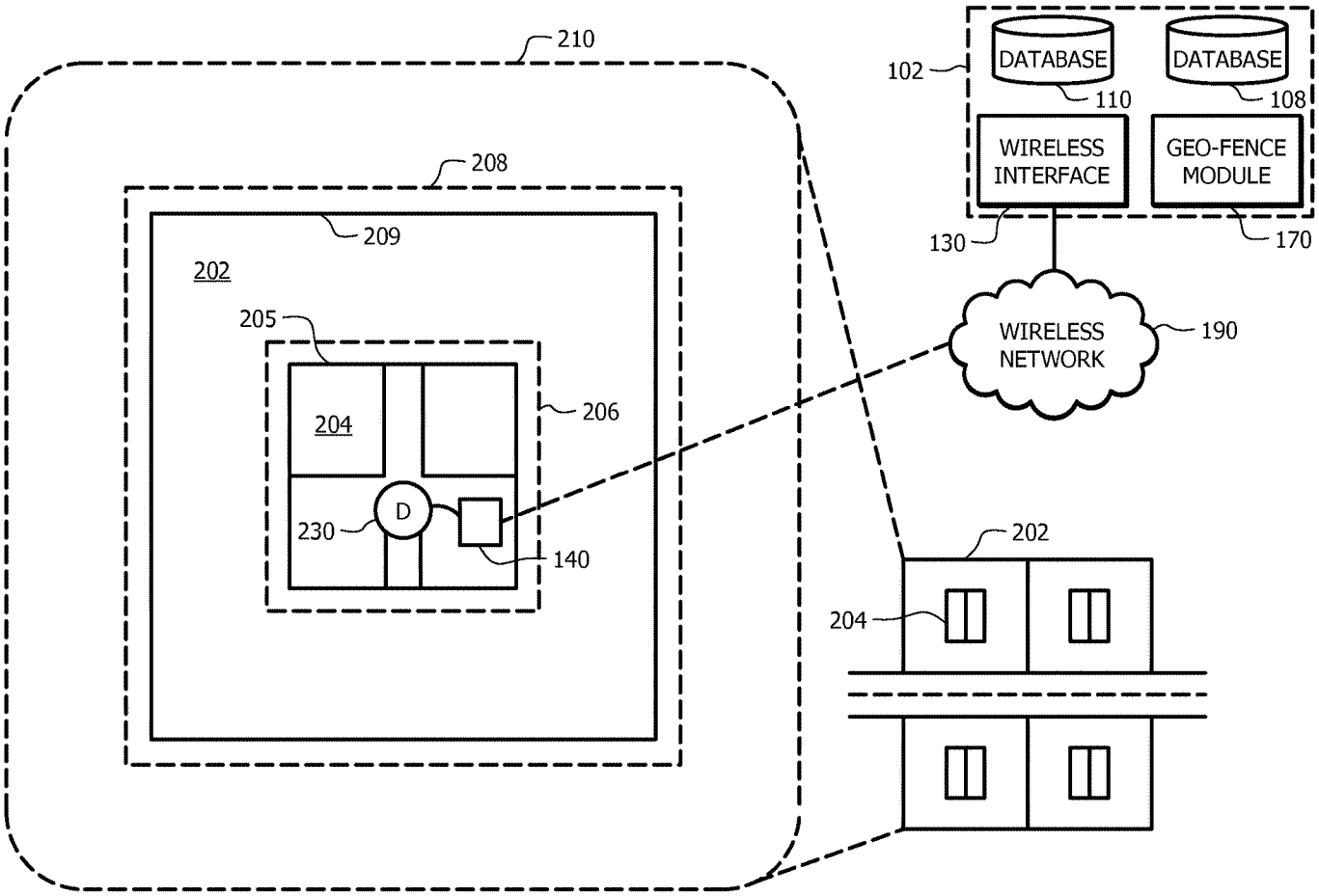
FIG. 2 is a diagram of a setting in which an embodiment of the present home incarceration confirmation system be deployed.

The initial setting of the geo-fence at the place of incarceration may occur in a variety of ways. A department of corrections official using client device 140 on which a geo-fence enabling application is installed may establish the boundaries of the geo-fence. FIG. 2 depicts a dwelling, the boundary of which will be enrolled in the present location confirmation system. In FIG. 2, location confirmation platform 102 includes geo-fencing module 170 and has associated detainee database 108 and schedule database 110. Location confirmation platform 102 communicates through a wireless interface 130 that facilitates communication over a wireless network 190 to at least one client device 140.

In FIG. 2, neighboring properties are shown along either side of a street. Assume property 202 is a property on which dwelling 204 sits. Dwelling 204 is a property of interest if that is the location of confinement of a particular detainee who is a client of the present home incarceration confirmation system. An expanded view of property 202 is provided in FIG. 2. Within dwelling 204 is detainee 230 having client device 140. Client device 140 includes an executable application for performing various functions associated with the present home incarceration confirmation system, including user interfaces for entering location data, biometric data and sending and receive messages including text, data and the like. The outer perimeter 205 of dwelling 204 is co-extensive with exterior walls of dwelling 204. Similarly, the entire property of interest 202 includes dwelling 204 and a yard area surrounding dwelling 204. The outer perimeter 209 of property 202 is co-extensive with the property line or an exterior physical fence surrounding property 202.

Client device 140 in communication with geo-fencing module 170 enables creation of the geo-fence boundary for dwelling 204 and property 202. As shown, a virtual dwelling boundary 206 surrounds dwelling 204 and a virtual property boundary 208 surrounds property 204. Detainee or department of corrections official 230 is situated within dwelling 204. In addition, an extensive virtual boundary 210 that extends beyond the real outer perimeter 209 of property 202 may also be created if a detainee may be permitted to traverse the real property line in some limited fashion.

Figure 3:
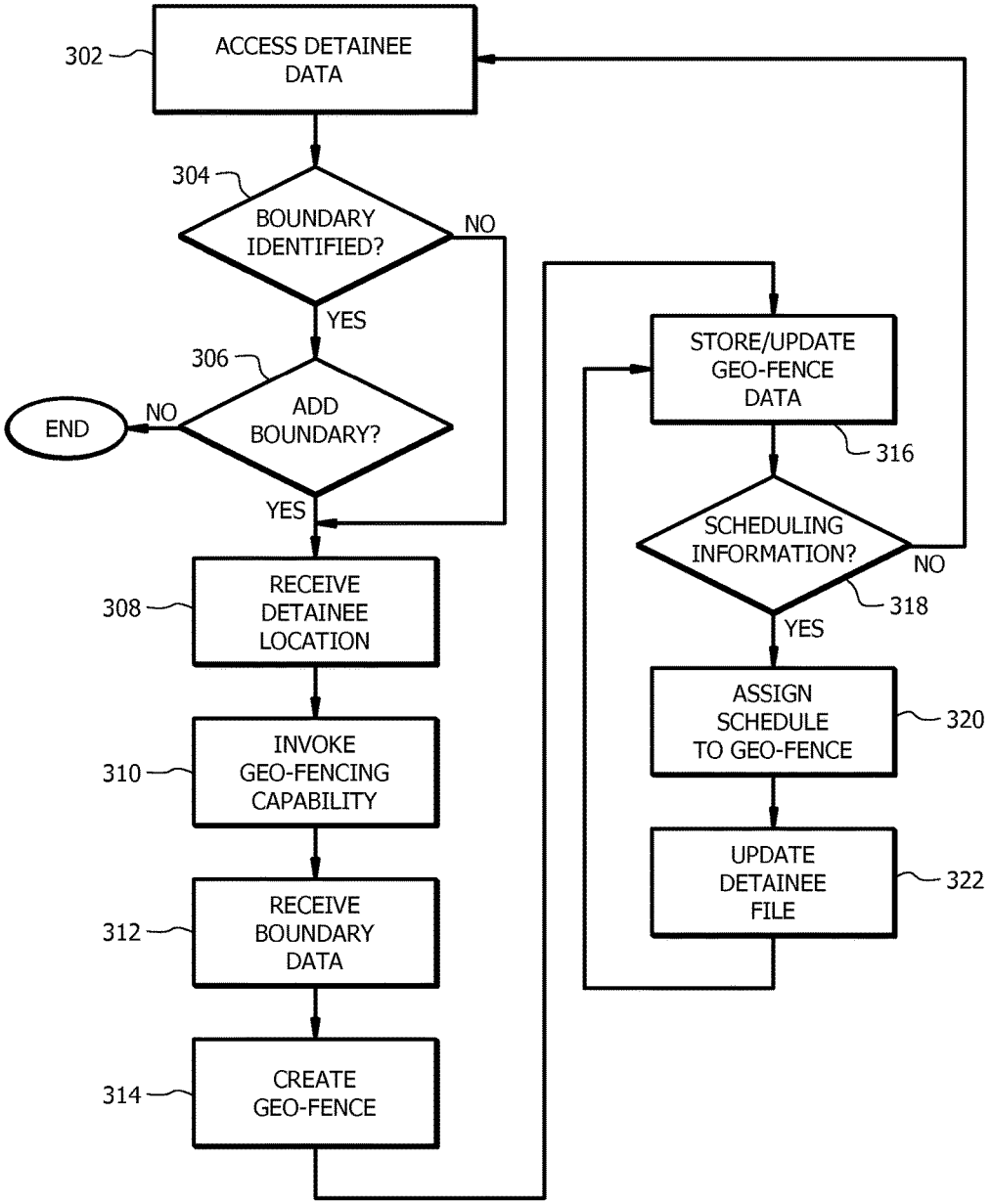
FIG. 3 is a flow diagram of a process of establishing virtual boundaries according to an embodiment of the present home incarceration confirmation system.

The virtual boundaries described above may be created in a number of ways. FIG. 3 is a flowchart describing various steps performed by the location confirmation platform 102 and/or the associated geo-fence module 170 to create the virtual property boundary 208 or virtual dwelling boundary 206. An embodiment of the process depicted in FIG. 3 may be performed by execution of programmable instructions residing at least in the department of corrections server 104, geo-fencing module 170, one or more client devices 140 and an intermediate software module in association with the location confirmation platform 102 via various network media, such as a wireless or cellular network, and in accordance with various know communication protocols.

In FIG. 3, at step 302, the data file of an individual detainee is accessed from the detainee database 208. At this juncture, the detainee may be an individual previously enrolled in the house incarceration confirmation system or a new enrollee. Once a record of a detainee is retrieved, the process continues to decision point 304 where it is determined whether any boundary data for this detainee has been established. It is contemplated that the detainee file will include a designation indicative of whether or not the schedule database includes boundary data for this detainee. In the alternative, the detainee file may include a link to a boundary data file for this detainee if one exists. By activating the link, the user interface at administrator device 120 may be presented with a visual representation of the detainee's place of home incarceration as well as the extent of a pre-existing virtual boundary. If the detainee is permitted to visit places outside of the home, such as a place of employment of for medical treatment, links to those locations are presented to the administrator as well.

If at decision point 304 it is determined that no boundary has been identified for an detainee, the process proceeds to step 308. On the other hand, if at decision point 304 it is determined that there is at least one boundary identified for a detainee, the process continues to decision point 306, where it is determined whether another boundary must be associated with the detainee. If no additional boundary designation is necessary, the process ends at step 307. If, on the other hand, an additional boundary designation is needed, the process proceeds to step 308.

At step 308, the geo-fence module 170 receives detainee location data. Once detainee location data is received, the geo-fencing capability of the location confirmation platform 102 is invoked as step 310. The geo-fence module receives real boundary data associated with the property or dwelling to which the detainee may be restricted at step 312 and the geo-fence or virtual boundary is created at step 314 and stored at step 316.

The virtual boundary creation associated with the detainee's place of confinement described with reference to the steps above may be executed in a variety of ways. Detainee location data may be received or retrieved by the geo-fence module in a number of ways. In one embodiment, the virtual boundaries may be created in predesignated a pre-determined manner based on property data residing in a database associated with the geo-fence module 170 of location confirmation platform 102, which may be the schedule database 110, detainee database 108 or other database. Pre-designated data may be property survey information made available through state or local agencies that reflect actual dimensions of a dwelling or property as a whole. To invoke boundary creation in this manner, the location confirmation platform 102, via wireless network 190, calls or pings client device 140 to ascertain its location. When the client device 140 "answers" this call by, for example, the official activating a key on the user interface of the client device 140, the location or coordinates of client device 140 are established using a GPS locate capability that is executed through software residing in the geo-fencing module. Once this location is ascertained, the parameters of the boundary may be invoked by the geo-fencing module in a variety of ways. In one embodiment, the actual footprint of the dwelling 204 and/or property 202 gleaned from property tax or real estate records may be used to create a virtual dwelling boundary 205 or virtual property boundary 208. The resulting boundary geographically reflects the actual footprint of the dwelling or property and is stored in scheduling database 110.

In an alternative embodiment, the location of the client device called is established as described above. Next the boundary of the dwelling or property is created based on data concerning the property previously stored in a database associated with the geo-fence module. This information may be gleaned from survey information made available my state or local taxing authorities or county real estate records. Based on this information, the square footage of the dwelling or property may be ascertained. Once the dimension of the property or dwelling are known, the geo-fence module 170, via software associated with the module, may establish a virtual property boundary 208 about property 202 and/or virtual dwelling boundary 205 about dwelling 204 according to the approximate dimensions of the property or dwelling. That is, the boundary may not precisely co-extend to the real boundary of the dwelling 204 or property 202, but an approximation of the boundary is created based on the real dwelling or property size. Once created, the virtual property boundary 208 and/or virtual dwelling boundary 205 are stored in a database associated with the location confirmation platform 102.

In addition, an extensive virtual boundary 210 may be created in a similar manner that extends beyond the real property boundary 209 or real dwelling boundary 205 in the event that the detainee is to be given some leeway in terms of the area he or she may traverse. By example, the geo-fence module may add a percentage to the overall square footage of the property and establish a virtual property boundary 208 or virtual dwelling boundary 206 that extends beyond the actual boundaries by some distance or percentage that is acceptable under the circumstances to department of corrections officials.

In another embodiment, the virtual boundary may be established by leveraging satellite imagery and online maps identifying a dwelling or property, such as that typically available online through websites such as Google Maps. Through such websites, and through software residing on or in connection with the geo-fence module 170, the location of client device 140 may be plotted and the virtual boundary of the dwelling or property may be approximated based on the size and scale of the online map.

In another embodiment, the virtual boundary may be established by plotting property boundary points with the client device and transmitting the boundary point data to the geo-fence module 170, and leveraging GPS functionality within the device 140 and the geo-fence module 170 to create a virtual boundary based on the exterior points of the property 202 or dwelling 204. In one embodiment, the user interface of client device 140 may provide an activation key that is depressed to plot a point on the property or located outside or in close proximity to the dwelling.

In another embodiment of the location confirmation platform 102, the detainee's location is tracked in real time using GPS data once the detainee leaves the place of confinement. Using known GPS techniques residing in a client device, corrections officials are able to accurately monitor the movements and location of a detainee. Location data may be stored in a local device affixed or worn by the detainee and the data is reported to confirmation platform 102 where it is stored and compared data concerning the detainee's expected whereabouts at a particular time period.

Returning to FIG. 3, following storage of geo-fence data resulting from the creation of a boundary at step 316, the process continues to decision point 318 where it is determined whether any particular scheduling information associated with the detainee is relevant for purposes of the location confirmation system. In embodiment, the default rule is that once a boundary is set for a detainee is expected to be located within that boundary twenty-four hours per day. If there is no scheduling information associated with this detainee, then the process proceeds to back to step 302 and the file of another detainee may be examined or updated. If, on the other hand, some scheduling circumstance for a particular detainee is determined at step 318, then the process proceeds to step 320 where scheduling information is assigned to a virtual boundary or geo-fence previously set for the detainee. Assuming two geo-fences have been set for a detainee, the first being the detainee's dwelling and the second being the detainee's place of employment, then each geo-fence will have associated with it the hours of the day during which the detainee is expected to be at each location. For example, if the detainee works from 9:00 a.m. to 1:00 p.m. on Monday and Wednesday, these time spans will be associated with the geo-fence for the detainee's place of employment. The remaining hours of the week will be associated, by default, with the detainee's dwelling, which is the primary location of incarceration. At step 322, the detainee's record is updated to reflect that the scheduling change was made, and the process returns to step 302 where another detainee's data may be accessed. In this manner, when a detainee is polled to determine location, the location confirmation platform 102 will not generate false alerts due to the detainee's absence from his primary dwelling although he is at his work location at an authorized time.

Once a detainee is enrolled in the present house incarceration confirmation system the individual's personal data is stored in a detainee database, schedule data reflecting any other locations where the detainee is authorized to visit and geo-fence or virtual boundaries have been established for a particular detainee, the present house incarceration confirmation system operates to monitor the status of the detainee. The data obtained by the detainee at the time of enrollment includes biometric data that is stored in the detainee database and/or scheduling database and is used to confirm confirmation communications that will be discussed. Biometric data is information pertaining to an individual's characteristics, such as a fingerprint, facial features or voice patterns. The location confirmation system 102 employs fingerprint or thumbprint recognition technologies, and facial and voice recognition technologies as tools in conjunction with GPS tracking capabilities to confirm detainee confirmation messages, as described below.

Figure 4:
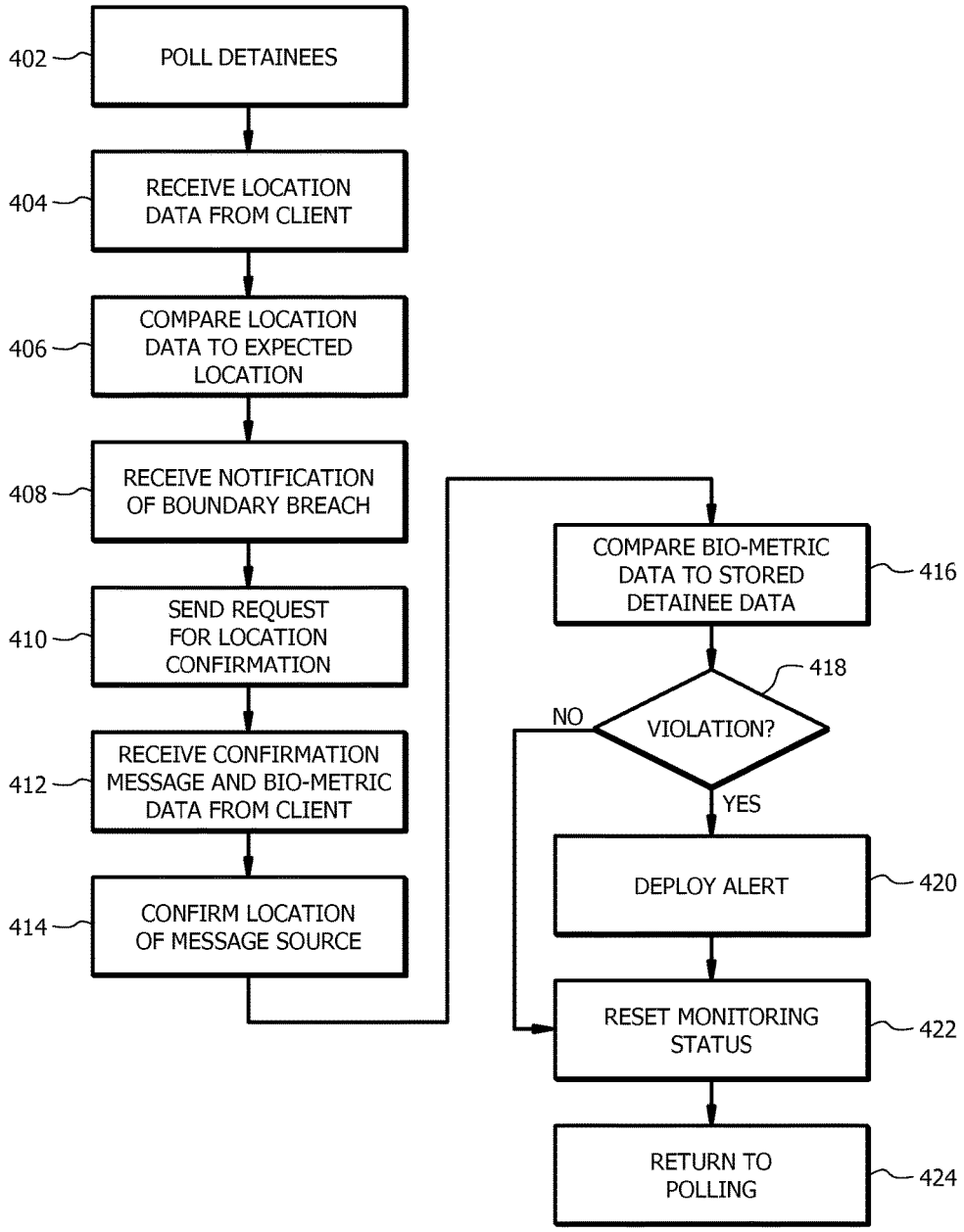
FIG. 4 is a blow diagram of a process of confirming the location and identity of a client according to the present home incarceration confirmation system.

FIG. 4 is a flowchart depicting an embodiment of a process executed by the present home incarceration confirmation system. The steps and processes depicted in FIG. 4 may be performed by execution of programmable instructions residing at least in part in the department of corrections server 104, geo-fencing module 170, one or more client devices 140 and/or an intermediate software module in association with the location confirmation platform 102 via various network media, such as a wireless or cellular network, and in accordance with various know communication protocols.

The present house incarceration confirmation system is designed to provide real-time monitoring of detainees through hardware and software that will promote accurate and fraud resistant accounting of detainee whereabouts. The system will make house detention safer and more effective alternative to institutional confinement, which suffers from overcrowding and high cost. The process of the embodiment described in FIG. 4 provides an efficient location confirmation system. In general, based on the GPS capabilities of the present house incarceration confirmation system, the location of a detainee may be ascertained simply by locating the client device 140 and confirming that the location of the client device 140 is at the expected location. If this practice alone proves faulty because of its susceptibility to fraud, then the client device operating in conjunction with an established geo-fence or virtual boundary for a detainee provide an alert when a detainee departs from the expected place of confinement. In this manner the system operates much like an RFID tag and sensor that activates an alarm when an item on which the tag is affixed traverses an RFID reader.

The union of a client device 140 and the geo-fence alone may not be sufficient, however, as known devices such as ankle bracelets may be manipulated so as to not be detected when crossing a particular boundary. Alternatively, a smart phone operating as the client device 140 provides sophisticated GPS capabilities and other applications that will assist corrections personnel in monitoring a detainee's status. Yet the smart phone alone does not alleviate all of the fraud concerns as the detainee may simply leave the device behind and leave the place of confinement. An application, however, that may be downloaded to a smart phone that facilitates communication with the location confirmation platform 102 via a wireless protocol eliminates these shortcomings by providing an effective and virtually fraud resistant communications link through which corrections officials may monitor the detainee's location and at desired intervals or at random times confirm the detainee's location.

The process of FIG. 4 begins with step 402 in which in which a detainee or group of detainees are polled. In operation, the operator of the confirmation system will ping the device of the incarcerated individual to ascertain location information and invoke the location confirmation process. This may be achieved in a variety of ways. For example, some detainees may be assigned a status that invokes a frequent polling requirement. This status is associated with the detainee and made part of the detainee data stored in detainee database 208 and scheduling database 210. All such designated detainees may be polled together. In this context, at the time at which polling is to occur, the location confirmation system 102 pings or calls the designated client device 140 to receive its location data. Assuming the client device 140 is a smart phone, then the device 140 is likely within the boundary of the required place of confinement when polled. When location data is received, location confirmation system 102 compares the location of the phone to the expected location and the interior of the boundary area. If the device location is outside of the area in which the device is expected, location confirmation system 102 generates an alert at step 408. Next, at step 410, location confirmation system 102 automatically in response to the alert or an administrator from administrator device 120 sends an individual request over, for example, a wireless or cellular network, to the detainee's client device 140 requesting that the detainee's location be confirmed.

At this juncture, the detainee receives the individualized request to confirm the location of the detainee. In an embodiment of the present home incarceration confirmation system, the detainee must send a confirmation message back to the location confirmation system 102 that includes indicia of authenticity. Such indicia is in the form of biometric data unique to the detainee. The biometric identification information may be in the form of a digital representation of finger or thumbprint, a digital profile of a detainee's facial features or a digital representation of the detainee's voice when reciting a particular word or phrase. The location confirmation system 102 uses previously collected biometric identification information and compares it to currently receive biometric information to determine the legitimacy of the detainee's confirmation message and location.

Continuing with FIG. 4, the process proceeds to step 412, where in response to the request sent to the client device, location confirmation system 102 receives a confirmation message from client device 140. This message includes one or more forms of biometric identification data input by the detainee at the time the request was sent. In one embodiment, the client device 140 may be equipped with a thumbprint sensor much like that equipped on the Apple iPhone 6 or other smart phones. In operation, the application residing on the device requires that the confirmation sent in response to the confirmation request of the location confirmation system 102 be sent while the detainee's thumbprint is sensed by the sensor. Such sensor technologies measure the contours of an individual's thumbprint and create a digital representation of it that reflects measurements of the features of the thumbprint according to an application program residing in the device. Since in theory no two finger or thumbprints are alike, the digital representation of the detainee's thumbprint will be virtually unique to that detainee.

In addition, location confirmation system 102 administrators may require additional biometric information from the detainee in the event an alert notification is received. If device 140 is equipped with a camera or microphone, the location confirmation system 102 instruction of application residing on client device 140 will be invoked that will cause the detainee to take a full face photograph of himself and record his own voice reciting a word or phrase that is the same word of phrase recorded of the detainee at the time of enrollment. Once the detainee's facial photograph is taken and/or voice recording is made, the detainee will send the identification items to location confirmation system 102 while the detainee's thumb is placed on the sensor key or pad of the client device. As a result of this operation or series of operations, location confirmation system 102 will receive multiple pieces of information from the detainee that may be used to confirm the detainee's location. Location confirmation system 102 will receive location data of client device 140 corresponding to the location of the device when the confirmation message was sent. In addition, location confirmation system 102 will receive a photograph of the face of the detainee as well as a voice recording of the detainee reciting the previously recorded word or phrase. Location confirmation system 102 will also receive a digital profile of the detainee's thumbprint, along with a time stamp associated with the creation and transmission time of all identification items.

The significance of transmission of the digital profile of the detainee's thumbprint is that the confirmation message could not have been sent if the detainee was separated from client device 140 or by someone other than detainee because of the uniqueness of the thumbprint.

Once this confirmation message and data is received by location confirmation system 102 at step 412, location confirmation system 102 first confirms the location of client device at step 414. The inquiry at this juncture is whether the confirmation information received by the detainee reflects a location that is one where the detainee is authorized at that time. This determination may be made in a number of ways, and in one embodiment by plotting the location at the time of message transmission by the detainee and determining if that location falls within a pre-established geo-fence for this detainee. If the source location is a location that is an authorized location, location confirmation system 102 proceeds to confirm the authenticity of the message by confirming that the sender was in fact the detainee. This is accomplished by comparing the newly received identification data, which may be one or all of the detainee's purported thumbprint, facial photograph and voice recording to previously recorded or retrieved items that are stored in one of the databases associated with location confirmation system 102. Software residing on or in association with location confirmation system 102 embodying voice and facial recognition techniques compares the received voice and facial data to pre-existing detainee files and determines if the two sets of data match. The digital profile of the thumbprint is also compared to a previously obtained thumbprint or thumbprint profile and similar software residing on or in association with location confirmation system 102 performs a comparison.

Once the comparison of step 416 is complete, the process of FIG. 4 proceeds to decision point 418, when it is determined if the detainee is confirmed as the sender of the confirmation message and the confirmation message was sent from the expected, authorized location. If the detainee is confirmed as the sender of the confirmation message and the message was sent from an authorized location, there is no apparent violation and the process proceeds to step 422, discussed below.

On the other hand, if at decision point 418 either the detainee cannot be confirmed as the sender of the confirmation message or the location from which the message was sent is not an authorized location, at step 420 location confirmation system 102 deploys corrections personnel to locate the detainee and/or client device and an alert that detainee is in breach of his home confinement terms is dispatched. Next the process continues with step 422, where the detainee's monitoring status may be reset or updated to reflect these events. For example, if the detainee's response and whereabouts are confirmed as acceptable, corrections administrator's may wish to flag this detainee for heightened, more frequent, or random monitoring and the detainee's file and corresponding scheduling data may be updated accordingly. In the event of a breach, the detainee's and scheduling files may be similarly updated, provided home incarceration is still an option.

The confirmation process described above was, in one embodiment, invoked by virtue of regular location data received by the phone through general GPS data collection and identification techniques. The confirmation process performed by the present home incarceration confirmation system may, however, also be invoked when a detainee simply leaves an authorized location and crosses the corresponding virtual boundary created by the geo-fence module 170. Once the detainee crosses the boundary and the GPS tracking capability in the client device 140 and location confirmation system 102 senses the breach, then correction officials may similarly engage in the confirmation process described by reference to FIG. 4 to attempt to confirm the detainee's location and correct a possible false alarm prior to deploying police or corrections personnel to the place of confinement and initiating a search for the detainee.

While the disclosed embodiments have been described with reference to one or more particular implementations, these implementations are not intended to limit or restrict the scope or applicability of the invention. Those having ordinary skill in the art will recognize that many modifications and alterations to the disclosed embodiments are available. Therefore, each of the foregoing embodiments and obvious various thereof is contemplated as falling within the spirit and scope of the disclosed inventions.

The invention claimed is:

1. A computer-implemented method for computerized location confirmation of an incarcerated individual, comprising executing on a processor the steps of:

presenting on a computerized user interface a graphical representation of a location of an incarcerated individual;

receiving an electronic communication containing physical characteristic data of an incarcerated individual and source location data;

retrieving from a storage medium associated with the processor a client file containing personal feature profile data of the incarcerated individual;

a first comparison of the received physical characteristic data to the retrieved personal feature profile data;

a second comparison of the received source location data to a predefined location; and updating the client file according to a result obtained from the first comparison and the second comparison;

wherein receiving step comprises receiving physical characteristic data and source location data from a mobile device, and wherein said mobile device is in communication with a wearable article, wherein said wearable article comprises a non-removable design which becomes damaged upon removal, and wherein said mobile device comprises a user interface and a biometric data input device.

2. The method of claim 1, wherein the physical characteristic data is a representation of a fingerprint of the incarcerated individual, and wherein upon removal of said wearable device a circuit is open and a breach is detected by said mobile device.

3. The method of claim 1, wherein the physical characteristic data is a representation of a facial feature of the incarcerated individual.

4. The method of claim 1, wherein the mobile device comprises a smartphone, and wherein said wearable device comprises a monitoring band.

5. The method of claim 1, further comprising sending a computer generated alert to a remote receiver indicating an actual location of the incarcerated person.

6. The method of claim 1, wherein the graphical representation of a location of an incarcerated individual includes a representation of a virtual boundary of an authorized location of the individual.

7. A system for confirming a location of an incarcerated individual, comprising:

a processor that generates an alert by identifying a difference between a physical characteristic data and a person feature profile data;

a first memory for storing the personal feature profile data;

a second memory for storing an authorized region of incarceration;

wherein the processor further compares stored personal feature profile data to a received physical characteristic data and compares a geographic location of a sender of the physical characteristic data with the authorized region of incarceration, and wherein the processor further updates the personal feature profile data;

a wearable article in communication with a mobile device, wherein said mobile device sends said received physical characteristic data and said geographic location, wherein said wearable article comprises a non-removable design which becomes damaged upon removal, and wherein said mobile device comprises a user interface and a biometric data input device.

8. The system of claim 7, further comprising a processor that presents on a computerized user interface a graphical representation of a location of an incarcerated individual.

9. The system of claim 7, wherein the physical characteristic data is a representation of a fingerprint of the incarcerated individual.

10. The system of claim 7, wherein the physical characteristic data is a representation of a facial feature of the incarcerated individual.

11. The system of claim 7, wherein the mobile device comprises a smartphone, and wherein said wearable device comprises a monitoring band.

12. The system of claim 8, wherein the graphical representation of a location of an incarcerated individual includes a representation of a virtual boundary of an authorized location of the individual.

13. The system of claim 12, wherein the virtual boundary is defined by the processor according to a global positioning system technique.

14. The system of claim 7, further comprising a physical characteristic input interface for collecting physical characteristic data.

15. A system for confirming the location of an incarcerated individual, comprising a mobile device, comprising a global positioning system receiver, a microprocessor and a wireless communication transceiver coupled to the global positioning system receiver;

a user interface, comprising a display and a physical characteristic input for recording an attribute of the incarcerated individual; and a storage medium, wherein the mobile device is programmed to send device location and physical characteristic data to a remote system and receive a request for the mobile device location confirmation; and further comprising a wearable article in communication with the mobile device and a local control unit in communication with the wearable article and the mobile device, wherein said wearable article comprises a non-removable design which becomes damaged upon removal and wherein said mobile device comprises a user interface and a biometric data input device.

16. The system of claim 15, wherein the physical characteristic input is a fingerprint sensor for recording a fingerprint of the incarcerated individual.

17. The system of claim 15, wherein the physical characteristic input is a digital camera for recording a representation of a facial feature of the incarcerated individual.

18. The system of claim 15, wherein the mobile device comprises a smartphone, and wherein said wearable device comprises a monitoring band.

19. The system of claim 15, wherein the wearable device comprises a closure which when closed completes an electric circuit that invokes communication with the local control unit.

* * * * *